US006511387B2

(12) United States Patent
Grieb

(10) Patent No.: US 6,511,387 B2
(45) Date of Patent: Jan. 28, 2003

(54) GOLF CLUB

(76) Inventor: LaRue O. Grieb, 22 Pleasant Dr., Bernville, PA (US) 19506

( * ) Notice: Subject to any disclaimer, the term of this patent is extended or adjusted under 35 U.S.C. 154(b) by 0 days.

(21) Appl. No.: 09/920,828

(22) Filed: Aug. 3, 2001

(65) Prior Publication Data

US 2002/0032074 A1 Mar. 14, 2002

Related U.S. Application Data

(60) Provisional application No. 60/222,909, filed on Aug. 4, 2000.

(51) Int. Cl.[7] ..... A63B 53/04

(52) U.S. Cl. ..... 473/330; 473/336; 473/341; 473/349

(58) Field of Search ..... 473/334, 335, 473/336, 337, 338, 339, 340, 341, 290, 291, 349, 558, 330

(56) References Cited

U.S. PATENT DOCUMENTS

| | | | | |
|---|---|---|---|---|
| 3,941,390 | A | * | 3/1976 | Hussey |
| 3,966,210 | A | | 6/1976 | Rozmus |
| 4,508,342 | A | | 4/1985 | Drake |
| 4,655,459 | A | * | 4/1987 | Antonious |
| 4,828,266 | A | | 5/1989 | Tunstall |
| 4,869,507 | A | | 9/1989 | Sahm |
| 4,872,684 | A | | 10/1989 | Dippel |
| 5,013,041 | A | | 5/1991 | Sun et al. |
| 5,090,698 | A | | 2/1992 | Kleinfelter |
| 5,244,210 | A | | 9/1993 | Au |
| 5,246,227 | A | | 9/1993 | Sun et al. |
| 5,388,827 | A | | 2/1995 | Reynolds, Jr. |
| 5,433,441 | A | | 7/1995 | Olsen et al. |
| 5,433,444 | A | | 7/1995 | Chiuminatta et al. |
| 5,447,310 | A | | 9/1995 | Jernigan |
| 5,489,097 | A | | 2/1996 | Simmons |
| 5,501,461 | A | | 3/1996 | Donofrio |
| 5,571,053 | A | | 11/1996 | Lane |
| 5,597,364 | A | | 1/1997 | Thompson |
| 5,603,666 | A | | 2/1997 | Bowe |
| 5,643,100 | A | | 7/1997 | Zabytko et al. |
| 5,692,969 | A | | 12/1997 | Schooler |
| 5,803,830 | A | | 9/1998 | Austin et al. |
| 5,839,974 | A | | 11/1998 | McAllister |
| 6,012,989 | A | | 1/2000 | Saksun, Sr. |
| 6,012,990 | A | * | 1/2000 | Nishizawa |
| 6,095,931 | A | | 8/2000 | Hettinger et al. |
| D432,192 | S | | 10/2000 | Hicks |
| 6,171,203 | B1 | | 1/2001 | Huang |
| 6,270,422 | B1 | | 8/2001 | Fisher |

* cited by examiner

*Primary Examiner*—Sebastiano Passaniti
(74) *Attorney, Agent, or Firm*—Schlesinger Arkwright & Garvey LLP

(57) ABSTRACT

A golf club, the body of the club head is constructed from a first material and has a center of gravity and is adapted to receive a weight member, at least one weight member constructed from a second material having a density greater than that of the first material, the weight member having a center of gravity and is securely received in the club head body in a manner so that the center of gravity of the weight member is positioned below the center of gravity of the club head body.

20 Claims, 3 Drawing Sheets

GOLF CLUB

CROSS-REFERENCE TO RELATED APPLICATIONS

This application is a nonprovisional application claiming the benefit of U.S. Provisional Application Serial No. 60/222,909 filed on Aug. 4, 2000.

FIELD OF THE INVENTION

The present invention relates to golfing equipment and in particular, a golf putter.

BACKGROUND OF THE INVENTION

It is known to insert weights within the club head of a golf club for various purposes. For example, U.S. Pat. No. 3,966,210 to Rozmus discloses a putter head having weights inserted in the head transverse and parallel to the longitudinal axis of the body to provide a type of counterbalance to the club face. On the other hand, each of U.S. Pat. No. 5,501,461 to Donofrio and U.S. Pat. No. 4,872,684 to Dippel disclose barrel-shaped putter heads having weight plugs aligned in the putter head to increase the overall mass of the putter head.

None of the prior art golf clubs disclose a putter head having weights disposed in the head for purposes of lowering the center of gravity of the club head.

OBJECTS AND SUMMARY OF THE PRESENT INVENTION

It is an object of the present invention to provide a golf club, for example a golf putter, having a club head provided with a low center of gravity for purposes of improving club performance; including but not limited to, control and accuracy.

In summary, the present invention is a club head, the club head comprising a club head body constructed from a first material, the club head body having a center of gravity and adapted to receive a weight member, a weight member constructed from a material having a density at least greater than that of the first material is provided, the weight member having a center of gravity and being securely received in the club head body in a manner so that the center of gravity of the weight member is below the center of gravity of the club head body.

In addition to the above, the present invention is directed to a golf club having a club head as set forth above.

DETAILED DESCRIPTION OF THE PREFERRED EMBODIMENTS

Figure 1:
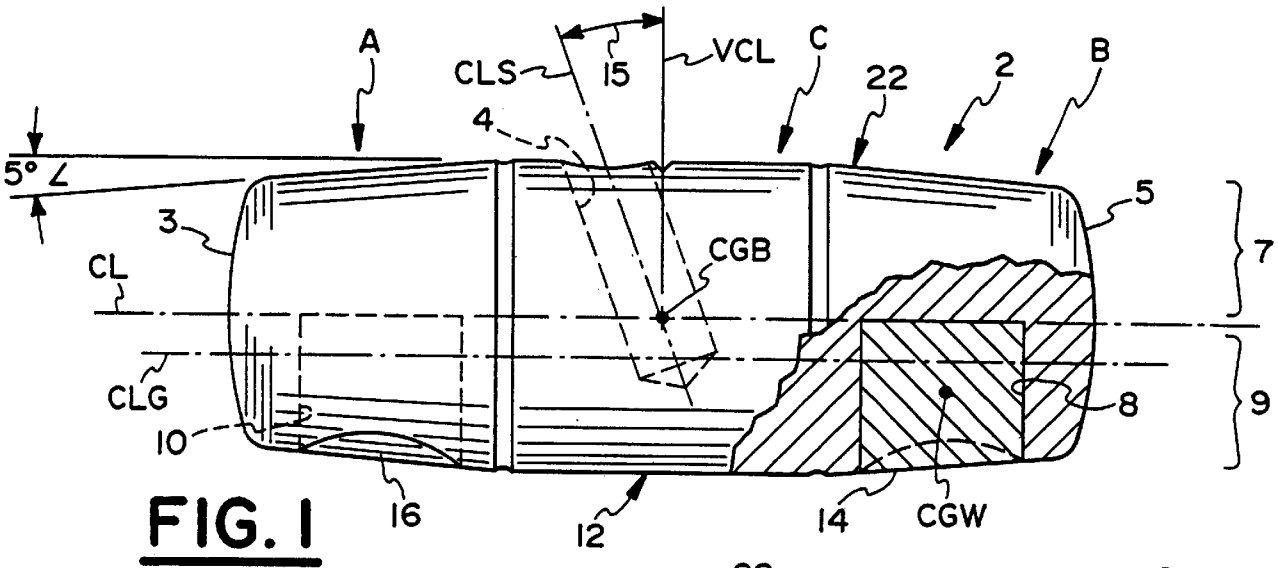
FIG. 1 is a side elevational view of the club head of the present invention with hidden lines to indicate location of the weight insert and portions broken away to illustrate the weight inserts.
Figure 2:
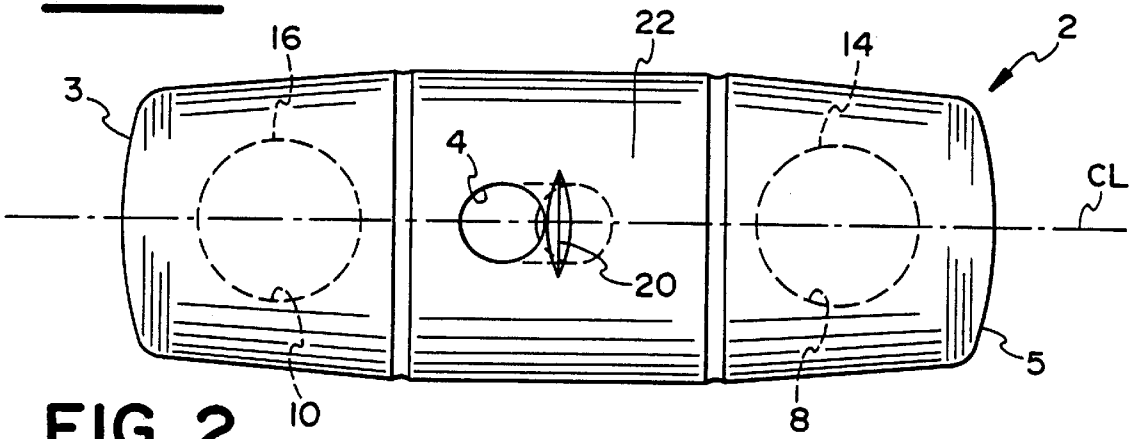
FIG. 2 is a top plan view of the club head shown in FIG. 1 including hidden lines showing location of the weight inserts and the end of the shaft recess.
Figure 3:
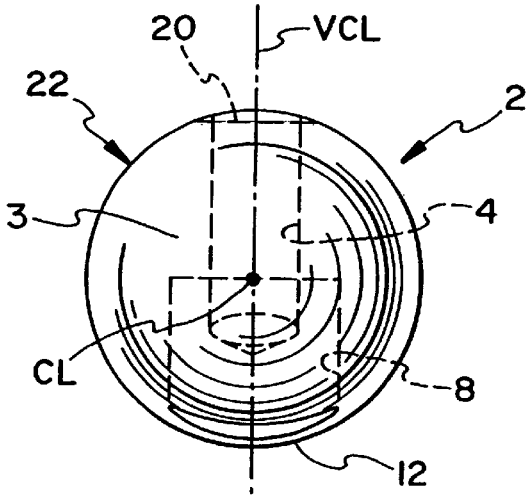
FIG. 3 is an end view of the club head shown in FIG. 1 and also including the hidden lines.

FIGS. 1 through 3 illustrate a club head according to the present invention and in particular, a club head for use within a golf club known as a putter. The club head is shown to generally comprises a generally elongated body 2 having frusto-conical opposed end segments A and B and a centrol cylindrical segment C and having a club face 3 at one end of the body 2 and a club face 5 at an opposite end of body 2. The bases of the frusto-conical end segments A and B have substantially the same circumference as that of the cylindrical segment C. As is apparent, it is within the scope of the present invention to provide other body configurations, the configuration shown being that of a putter. The body 2 is further provided with a top region 22 and a bottom region 12. Body 2 frusto-conical segments A and B are shown to be tapered towards each of club face 3 and club face 5 and as best shown in FIG. 1, a five degree slope or angle is created at each of the ends of club faces 3 and 5 for purpose of minimizing friction with the putting surface. It is within the scope of the present invention, depending upon design considerations, to provide a body 2 without the above noted taper or to increase or decrease the degree of slope.

Club head or body 2 is shown in each of FIGS. 1, 2 and 3 to have a longitudinally extending central axis or center line CL. The portion of body 2 extending above the plane created by center line CL comprises an upper section 7 and the portion of body 2 extending below the plane created by center line CL comprises a lower section 9. Club head or body 2 is shown in each of FIGS. 1 and 3 to also have a vertically extending central axis or center line VCL. In addition, club head or body 2 is shown in FIG. 1 to include a center line CLS corresponding to the central axis of a club shaft (not shown).

Figure 4:
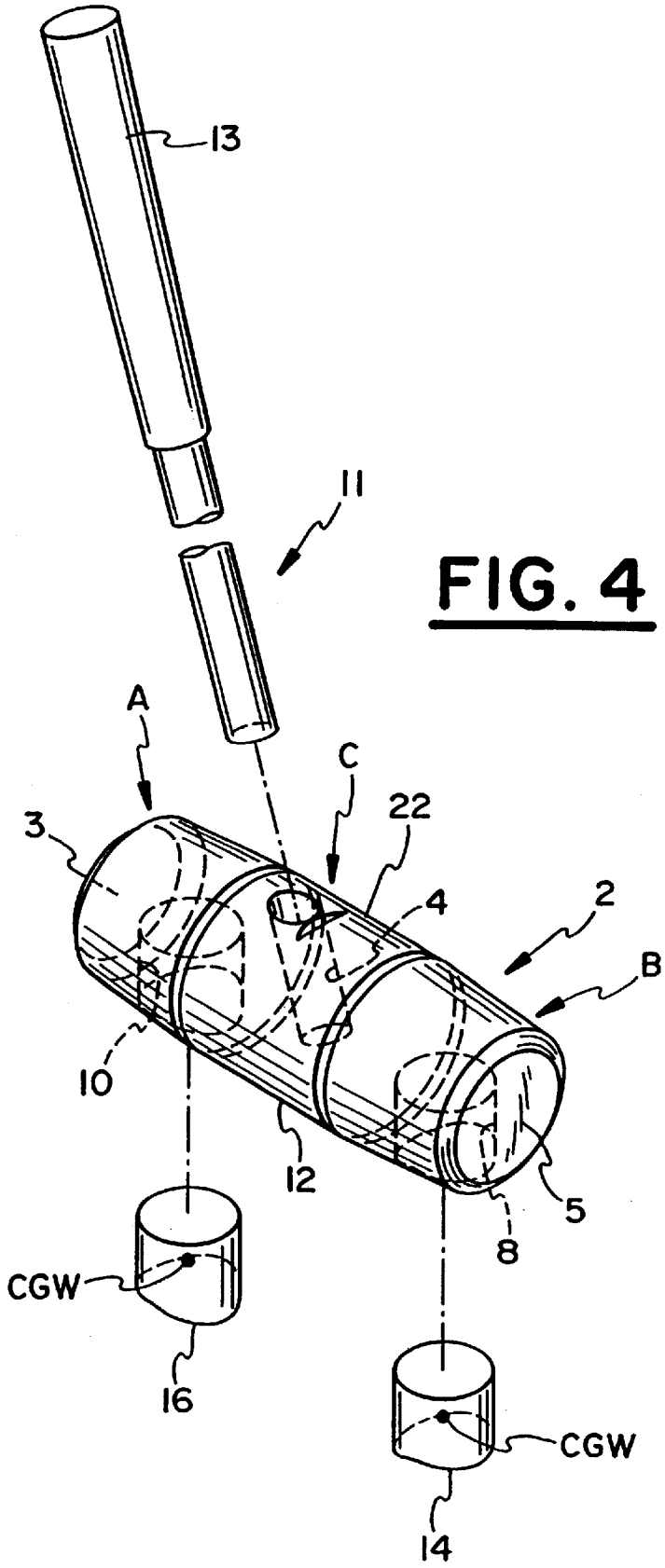
FIG. 4 is an exploded view of the golf club according to the present invention with the golf club shaft shown in broken lines.

A passage 4 is shown to extend into the top region 22 of club head or body 2, the passage 4 being sized to receive the end of a club shaft (not shown) in the known manner. FIG. 4 illustrates a club shaft 11 aligned for interconnection with the body 2 and insertion of the end of shaft 11 within passage 4. An opposite end of shaft 11 will include a handle 13 as is known in the art. In a specific embodiment, passage 4 has a diameter of about 0.372 inch and is disposed in body 2 at an angle of about twenty degrees, the angle extending between the vertical center line VCL and the center line of shaft CLS and as shown in FIG. 1 by arrow 15. As is apparent, the angle of the shaft may be varied depending upon preferred design considerations.

In a preferred embodiment, club head or body 4 as set forth above is constructed from a metal and in at least one preferred embodiment the material is aluminum, for example, AISI 6061-T6 aluminum. As is apparent, various other materials for construction of body 2 are within the scope of the present invention and depending upon design considerations, these materials may include various other metals and alloys such as stainless steel or titanium or synthetic materials such as plastics or carbon fiber materials as well as composites of metal and synthetics.

Returning to the figures, lower section 9 is provided with a pair of bores 8 and 10 extending into the bottom surface 12 of body 2, and extending into body 2 no further than the plane created by center line CL. As best shown in each of FIGS. 1, 2 and 3, bores 8 and 10 are in alignment with and extend transverse to the longitudinally extending central axis of body 2, the longitudinally extending central axis being represented in the drawings by center line CL. Other alignments are within the scope of the present invention depending upon design considerations without departing from the present invention.

Bores 8 and 10 are adapted to receive weight members shown in the drawings to be inserts or weight plugs 14 and 16 respectively, and in the usual case the weight members comprise a material having a density greater than that of the material comprising body 2. For example, the weight plugs may be constructed from brass or another material of relatively high density, the selection of the material being dependant upon the material comprising the body 2. Accordingly, owing to the differences in density of the respective construction materials, weight members 14 and 16 will each have a center of gravity CGW and club head body 2 will have a separate center of gravity CGB prior to being assembled with the weight members.

In a preferred embodiment and as shown in the drawing, bores 8 and 10 are disposed equidistant along the length of body 2 to provide a balanced club head or body 2 from end to end. If desired, it is within the scope of the invention to vary the spacing of the weight plugs along the longitudinal axis of the club head from that shown in the drawings. For example, the weight plugs could be disposed nearer to the respective club faces 3 and 5 or in the alternative further away from the club faces than that as shown in the drawings. As is apparent, this repositioning along the longitudinal axis may be done for design considerations. Further, a single weight member may be used or additional weight members from that shown in the drawings may be used without departing from the present invention. Weight plugs 14 and 16 may be press fitted, adhesively bonded or otherwise secured in any known matter within bores 8 and 10.

The position of weight members 14 and 16 in the club head body 2 will function to lower the center of gravity of the club head body 2. This lowered center of gravity is shown in FIG. 1 where club head 2 when assembled with weight members 14 and 16 will have a center line of gravity CLG below the center of gravity CGB of club head body 2 prior to assembly with the weight members 14 and 16. By positioning of the weight members 14 and 16 in the body 2 so that the center of gravity CGW for the weight members 14 and 16 is below the center of gravity CGB of club head body 2, a club head having a lowered center of gravity CLG is obtained owing to the respective density differences of the club head body 2 and the weight members 14 and 16. A club head as set forth above which has a low center of gravity provides improved balance, feel and accuracy during use.

As is apparent, the weight members of the present invention may be configured into any of a variety of shapes other than the cylindrical shapes shown in the drawings. The weight member may even comprise discrete material that is dispersed or grouped within the club head body. For example, brass material in the form of shavings or powder could be incorporated into a club head body constructed from graphite or some other synthetic material that is adapted to receive the discrete material, the center of gravity of the discrete material being below that of the golf club head.

In a specific embodiment of the present invention the body material is AISI 6061-T6 aluminum and the plugs 14 and 16 are constructed from brass. The body is provided with a length of about four inches and a diameter of about 1.437 inches. A deep cut 20 comprising a ninety degree angle about 0.040 inches deep extends into top surface 22 of upper section 7. When combined with a 34.750 long golf shaft having a standard putter grip, the putter weight will be about eleven ounces and the swing weight will be about D-6. With a club head a set forth above, the center line of gravity CLG is lowered about 0.163 inches from center line CL (and center of gravity CGB) to provide a club having improved control and accuracy.

During construction, the body may be CNC turned after the weight plugs are installed to further improve accuracy and balance of the overall putter body 2. As is apparent, the putter may be employed in either a right or left handed manner.

Figure 5:
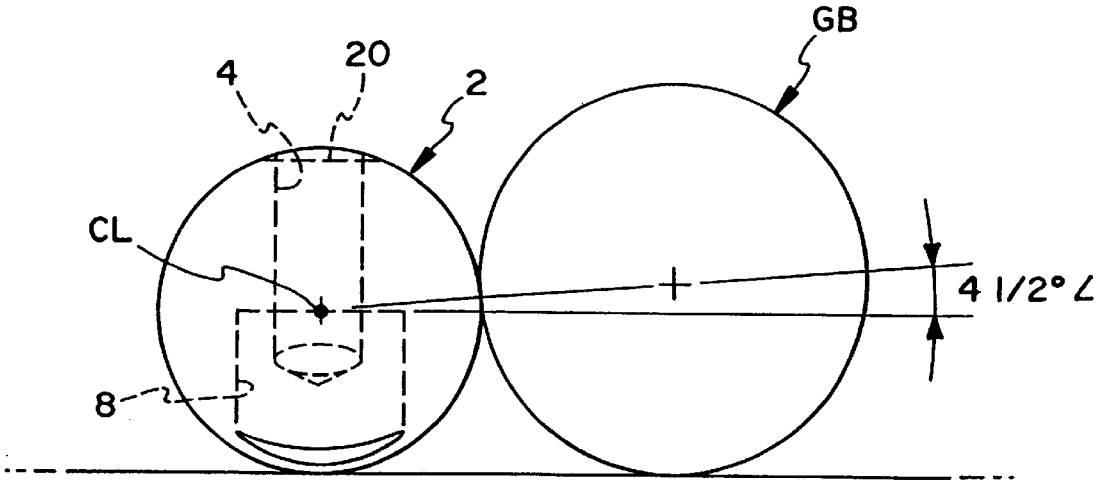
FIG. 5 is an end view similar to that of FIG. 3 and further including a golf ball shown in schematic lines.

Turning to FIG. 5, which shows body 2 aligned next to a golf ball GB on a flat surface, a club head as constructed in the specific embodiment set forth above will have a dynamic loft of about four and a half degrees.

While this invention has been described as having a preferred design, it is understood that it is capable of further modifications, and uses and/or adaptations of the invention and following in general the principle of the invention and including such departures from the present disclosure as come within the known or customary practice in the art to which the invention pertains, and as may be applied to the central features hereinbefore set forth, and fall within the scope of the invention or limits of the claims appended hereto.

I claim:

1. A club head for a golf club, the club head comprising:

a) a body, said body constructed from a first material and having a center of gravity, said body configured to receive a weight member;

b) said body having opposed frusto-conical end segments and a cylindrical central segment extending between said opposed frusto-conical end segments, said frusto-conical end segments adapted to reduce friction against said club head during use; and c) at least one weight member, said at least one weight member constructed from a second material having a density greater than that of said first material, said at least one weight member having a center of gravity and received in said body so that the center of gravity of said at least one weight member is positioned below the center of gravity of said club head body.

2. A club head as in claim 1 and wherein:

a) said body has an elongated configuration terminating at opposite ends thereof and has a longitudinal central axis extending therethrough, said at least one weight member received in said body is aligned along the central axis and extends transverse thereto.

3. A club head as in claim 2 and further including:

a) a second weight member, said second weight member received in said body and aligned along the central axis and extending transverse thereto.

4. A club head as in claim 3 and further including;

a) a pair bores extending into said body, each of said pair of bores for receiving a separate one of said at least one weight member and said second weight member.

5. A club head as in claim 4 and wherein:

a) said pair of bores are cylindrically shaped and said at least one weight member and said second weight member are shaped to be fixedly received within a separate one of each of said pair of bores.

6. A club head as in claim 2 and wherein:

a) each of said at least one weight member and said second weight member are received in said body adjacent to a separate one of said opposite ends thereof.

7. A club head as in claim 2 and wherein:

a) said at least one weight member is disposed beneath the longitudinally extending central axis of said body.

8. A club head as in claim 1 and wherein:

a) each of said first and second materials are selected from a group consisting of metal materials and synthetic materials.

9. A club head as in claim 8 and wherein:

a) said metal materials are selected from the group consisting of aluminum and brass.

10. A club head as in claimed 9 and wherein:

a) said synthetic materials are selected from the group consisting of plastic materials and composite materials.

11. A club head as in claim 1 and wherein each of said frusto-conical end segments has an angle of about five degrees.

12. A club head as in claim 1 and wherein said body has a dynamic loft of about four and one half degrees.

13. A golf club comprising:

a) a shaft, said shaft having a gripping portion at one end thereof and a lower portion at an opposite end thereof, said lower portion configured to receive a club head;

b) a club head secured to said opposite end of said shaft, said club head comprising a body constructed from a first material and having a center of gravity, said body configured to receive a weight member;

c) said body having opposed frusto-conical end segments and a cylindrical central segment extending between said opposed frusto-conical end segments, said frusto-conical end segments adapted to reduce friction against said club head during use; and d) at least one weight member, said at least one weight member constructed from a second material having a density greater than that of said first material, said at least one weight member having a center of gravity and received in said body so that the center of gravity of said at least one weight member is positioned below the center of gravity of said club head body.

14. A golf club as in claim 13, and wherein:

a) said body has an elongated configuration terminating at opposite ends thereof and has a longitudinal central axis extending therethrough, said at least one weight member received in said body is aligned along the central axis and extends transverse thereto.

15. A golf club as in claim 14 and further including:

a) a second weight member, said second weight member received in said body and aligned along the central axis and extending transverse thereto.

16. A golf club as in claim 15 and wherein:

a) each of said at least one weight member and said second weight member are received in said body adjacent to a separate one of said opposite ends thereof.

17. A golf club as in claim 14 and wherein:

a) said at least one weight member is disposed beneath the longitudinally extending central axis of said body.

18. A golf club as in claim 13 and wherein each of said frusto-conical end segments has an angle of about five degrees.

19. A golf club as in claim 13 and wherein said shaft has an angle of about twenty degrees to the center line of said club head.

20. A golf club as in claim 13 and wherein said body has a dynamic loft of about four and one half degrees.

* * * * *